US008333435B2

(12) United States Patent
Stratti

(10) Patent No.: US 8,333,435 B2
(45) Date of Patent: Dec. 18, 2012

(54) HOLDER FOR HOLDING A TOOTH ON A BODY OF A CUTTING BLADE OR GRINDING DRUM FOR CUTTING OR GRINDING ROCK OR HARD EARTH FORMATIONS

(75) Inventor: Troy Stratti, Chipping Norton (AU)

(73) Assignee: Taiga Investments Pty Ltd., Sydney NSW (AU)

( * ) Notice: Subject to any disclaimer, the term of this patent is extended or adjusted under 35 U.S.C. 154(b) by 230 days.

(21) Appl. No.: 12/161,988

(22) PCT Filed: Jan. 25, 2007

(86) PCT No.: PCT/AU2007/000071

§ 371 (c)(1),
(2), (4) Date: Dec. 9, 2008

(87) PCT Pub. No.: WO2007/085053

PCT Pub. Date: Aug. 2, 2007

(65) Prior Publication Data

US 2009/0302668 A1 Dec. 10, 2009

(30) Foreign Application Priority Data

Jan. 25, 2006 (AU) ..... 2006900359

(51) Int. Cl.
*E21C 25/10* (2006.01)

(52) U.S. Cl. ..... 299/39.3; 299/108; 299/39.1; 299/39.4; 175/427; 37/91

(58) Field of Classification Search ..... 299/100–113, 299/29, 36.1, 39.1, 39.3; 175/413, 427; 29/428; 174/427; 37/91, 94, 189
See application file for complete search history.

(56) References Cited

U.S. PATENT DOCUMENTS

| | | | | |
|---|---|---|---|---|
| 2,989,295 | A * | 6/1961 | Prox, Jr. | 299/108 |
| 3,158,403 | A * | 11/1964 | Adams et al. | 299/108 |
| 4,006,936 | A * | 2/1977 | Crabiel | 299/39.8 |
| 4,755,004 | A * | 7/1988 | Palmquist et al. | 299/106 |
| 5,302,005 | A | 4/1994 | O'Neill | |
| 6,712,431 | B1 | 3/2004 | Bosch et al. | |
| 6,779,850 | B1 * | 8/2004 | Schibeci et al. | 299/87.1 |

FOREIGN PATENT DOCUMENTS

GB 1546796 A1 5/1979

* cited by examiner

*Primary Examiner* — John Kreck
*Assistant Examiner* — Yong-Suk (Philip) Ro
(74) *Attorney, Agent, or Firm* — Weingarten, Schurgin, Gagnebin & Lebovici LLP

(57) ABSTRACT

A holder for holding a tooth on a body of a cutting blade or grinding drum for cutting or grinding rock or hard earth formations. The selectively-positionable holder includes a portion for holding the tooth in a manner such at that a portion of the tooth projects from the holder and a base surface for attaching the holder to an attachment surface of the body. When the holder is positioned in one of a plurality of orientations, the base surface has, within an area over the attachment surface, a shape which is profiled so that a region defined between the base surface and the attachment surface is, for at least one of the plurality of different orientations, smaller than a region that would be defined if the base surface would have a flat shape.

7 Claims, 4 Drawing Sheets

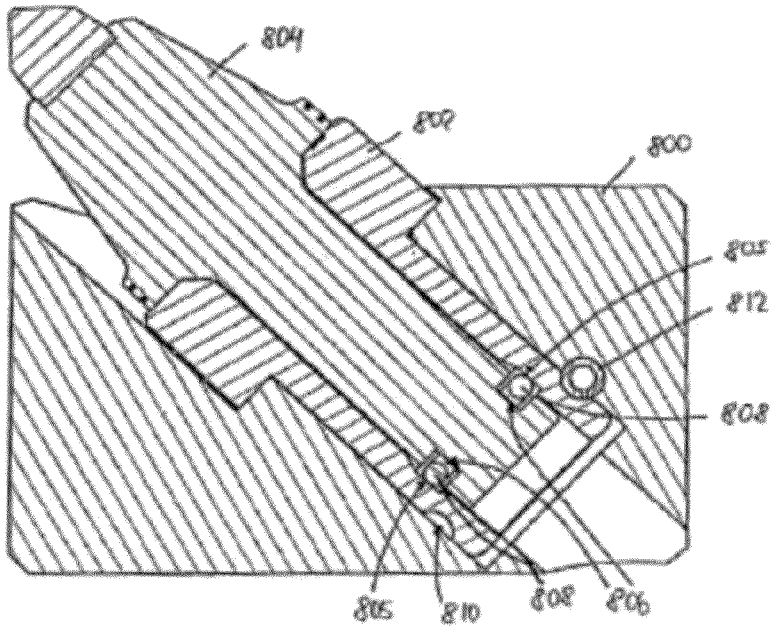
Fig. 8 (a)
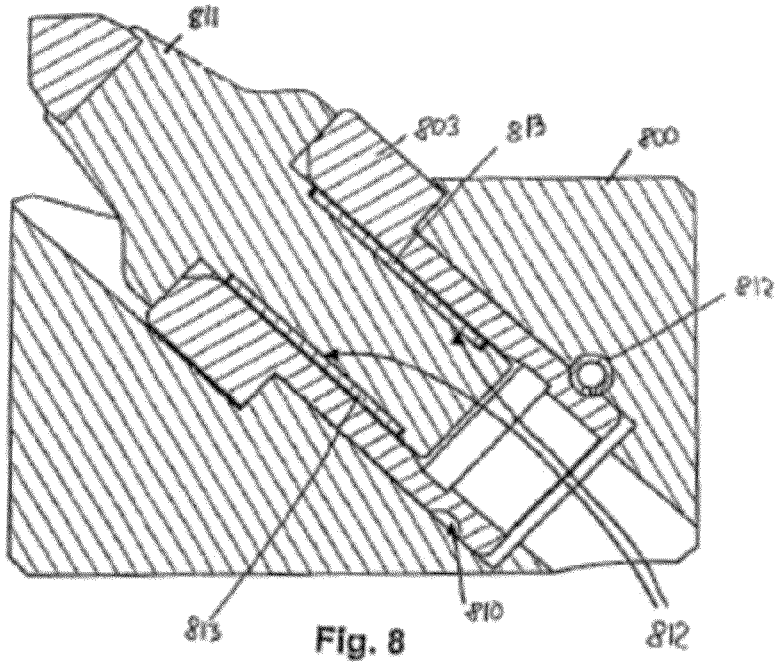
Fig. 8 (b)
Fig. 8

HOLDER FOR HOLDING A TOOTH ON A BODY OF A CUTTING BLADE OR GRINDING DRUM FOR CUTTING OR GRINDING ROCK OR HARD EARTH FORMATIONS

This application is a §371 national phase filing of PCT/AU2007/000071 filed Jan. 25, 2007, and claims priority to Australian Appln No. 2006900359 filed Jan. 25, 2006.

FIELD OF THE INVENTION

The present invention broadly relates to a cutting blade or grinding drum for cutting rock or hard earth formations. The present invention relates particularly, though not exclusively, to a holder for holding a tooth on a body of a cutting blade or grinding drum.

BACKGROUND OF THE INVENTION

Various devices for cutting, grinding and fracturing hard earth formations and rock during excavations (e.g. trimming or planing floor faces, rock side faces, trenching and general building footing detailing) are known in the prior art. Such devices can be mounted on the free end of an articulated arm of a tracked or conventionally wheeled excavator or the like.

For cutting or grinding such hard earth or rock formations, usually large cutting blades or grinding drums are used. For example, cutting blades typically have a diameter of more than 1-3 meters. The cutting blades or grinding drums may comprise a steel body, such as a disc or a cylinder respectively, having a circumferential surface from which a large number of cutting or grinding teeth project. Each tooth typically is positioned in a holder which is welded onto the circumferential surface. In order to improve the properties of the cutting blade or grinding drum, the holders are positioned so that the teeth have a plurality of different orientations relative to the circumferential surface. The holders may be positioned so that the teeth are tilted to either sides of a radial plane of the steel body by an angle between 0° and 45° and typically are arranged in a lace pattern around the body.

If a holder is positioned so that a respective tooth projects from the body in a direction that lies with a radial plane of the body, typically a relatively small amount of welding material is required for welding the holder onto the circumferential surface. If the holder is tilted so that the respective tooth projects more to one side of the radial plane, typically a larger gap having wedge-shaped cross-sectional profile is formed between the base surface of the holder and the circumferential surface of the body. Due to the larger gap more welding material is required for welding the holder onto the body which is detrimental for the structural strength. There is a need for technological advancement.

SUMMARY OF THE INVENTION

The present invention provides in a first aspect a holder for holding a tooth on a body of a cutting blade or grinding drum for cutting or grinding rock or hard earth formations, the body having an attachment surface for attaching the holder, the holder comprising:

a portion for holding the tooth in a manner such that a portion of the tooth projects from the holder, a base surface for attaching the holder to the attachment surface of the body, the holder being positionable in a plurality of different orientations in which the base surface is attachable to the attachment surface and in which the received tooth projects from the body in a predetermined direction, wherein, when the holder is positioned in one of the plurality of orientations, the base surface has, within an area over the attachment surface, a shape which is profiled so that a region defined between the base surface and the attachment surface is, for at least one of the plurality of different orientations, smaller than a region that would be defined if the base surface would have a flat shape.

The above-defined holder has a significant advantage compared with prior art holders. Prior art holders have a flat base surface. If the holder is positioned on the body in a tilted orientation, the flat base surface defines a wedge-shaped region together with the attachment surface of the body. Consequently such tilted orientations require more welding material for attaching the holder which reduces the mechanical strength. Further, the relatively large amount of welding material has the disadvantage that the orientation of the holder changes when the welding material cools due to shrinkage of the welding material.

In contrast, the holder according to the first aspect of the present invention has a base surface that is profiled so that a region defined between the base surface and the attachment surface is, for at least one of the plurality of different orientations, smaller than a region that would be defined if the or each surface would have a flat shape. For example, the base surface may have a convexly-curved cross-sectional shape. If such a holder is positioned in a tilted orientation, the gap between the base surface and the attachment surface is smaller compared with a gap that would be formed using a prior art holder. Consequently a reduced amount of welding material is required and the structural stability increased. Further, shrinkage of the welding material during cooling of the welding material is less problematic.

The base surface typically has rounded and/or angled surface portions and in one specific embodiment the entire base surface is curved. The base surface typically also has a relatively long extension in a direction along the attachment surface of the body which increases the welding area and improves bonding strength. For fabrication of the cutting blade or grinding drum the holder may be rotated on the attachment surface, typically by an angle between 0° and 260°, and secured in a position in which the respective tooth projects in the desired direction relative to the body. In one specific embodiment of the present invention the entire holder has a circular cross-sectional shape.

The portion for holding the tooth typically has a recess having a circular cross-sectional shape arranged for holding a tooth having a socket portion with circular cross-sectional shape. Alternatively, the portion for receiving the tooth may have a recess having a non-circular cross-sectional shape, such as an edged shape, arranged for receiving a tooth having a socket portion with a corresponding non-circular cross-sectional shape. In either case the portion for receiving the tooth may be arranged for attaching the tooth by welding, soldering, by a frictional fit such as a frictional fit of tapered portions, or by a pin such as a role pin.

The portion for holding the tooth may also be arranged for receiving the tooth via a sleeve or the like. In one specific embodiment of the present invention the holder comprises the sleeve which is securable in the portion for receiving the tooth by welding, by a frictional fit of tapered portions or by a pin such as a role pin. In this embodiment the portion for holding the tooth is arranged to receive a socket portion of the tooth via the sleeve. This embodiment has significant practical advantages. A grinding drum or cutting blade typically comprises a plurality of teeth with holders and the teeth projecting from the body receive significant impact during cutting or grind actions which may result in wear of external portions of the holders and also of the portions which hold the teeth in position. Typically the teeth are held in position in circular bores which may become oval due to the impact associated with the cutting action. In this case the teeth are not held in their preferred position and it will be necessary to repair the cutting blade. Repairing of the cutting blade or grinding drum having the holders with the sleeves according to the specific embodiment of the present invention is simplified. It typically is not necessary to replace the holders, which usually are carefully positioned on the body at a predetermined angular position, but typically only the sleeves needs to be replaced which usually can be performed in a routine manner without the need for specialised staff.

A series of the holders typically is positioned around the body. Adjacent holders of the series typically are in contact which further improves resistance to wear.

The present invention provides in a second aspect a cutting blade comprising a plurality of the above-defined holders.

The present invention provides in a third aspect a grinding drum comprising a plurality of the above-defined holders.

The present invention provides in a fourth aspect a cutting blade for cutting rock or hard earth formations, the cutting blade comprising a body having an attachment surface, the attachment surface having a width, the cutting blade further comprising a plurality of teeth and a series of holders for holding the teeth, each holder comprising:

a base surface attached to the attachment surface of the body and a portion holding one of the teeth in a manner such that a portion of the tooth projects from the holder, wherein the holders are attached to the body at least one of a plurality of different orientations in which the teeth project from the body in predetermined directions, and wherein at least one of the base surface and the attachment surface has, within the width of the attachment surface, a shape which is profiled so that a region defined between the base surface and the attachment surface is, for at least one of the plurality of different orientations, smaller than a region that would be defined if the or each surface would have a flat shape.

The series of the holders with teeth typically is positioned around the body of the cutting blade in a lace pattern. Each holder with a respective tooth typically is orientated to protect a preceding holder and tooth during a cutting action.

The present invention provides in a fifth aspect a grinding drum for grinding rock or hard earth formations, the grinding drum comprising a body having an attachment surface, the attachment surface having a width, the grinding drum further comprising a plurality of teeth and respective holders for holding the teeth, each holder comprising:

a base surface attached to the attachment surface of the body and a portion holding one of the teeth in a manner such that a portion of the tooth projects from the holder, wherein the holders are attached to the body at least one of a plurality of different orientations in which the teeth project from the body in predetermined directions, and wherein at least one of the base surface and the attachment surface has, within the width of the attachment surface, a shape which is profiled so that a region defined between the base surface and the attachment surface is, for at least one of the plurality of different orientations, smaller than a region that would be defined if the or each surface would have a flat shape.

The holders with teeth typically are positioned around the body of the grinding drum in a lace pattern.

Series of the holders typically are oriented in a spiral-like manner around the body of the grinding drum. Each holder with a respective tooth typically is orientated to protect a preceding holder and tooth during a grinding action.

The present invention provides in a sixth aspect a tooth for attachment to a body of a cutting blade or grinding drum for cutting or grinding rock or hard earth formations, the body having an attachment surface for attaching the tooth, the tooth comprising:

a base surface for attaching the tooth to the attachment surface of the body, the tooth being positionable in a plurality of different orientations in which the base surface is attachable to the attachment surface and in which the received tooth projects from the body in a respective direction, wherein, when the tooth is positioned in one of the plurality of orientations, the base surface has within an area over the attachment surface a shape which is profiled so that a region defined between the base surface and the attachment surface is, for at least one of the plurality of different orientations, smaller than a region that would be defined if the base surface would have a flat shape.

The present invention provides in a seventh aspect a method of attaching a holder for a tooth on a body of a cutting blade or grinding drum for cutting or grinding rock or hard earth formations, the holder having a portion for holding the tooth in a manner such that a portion of the tooth projects from the holder and a base surface for attaching the holder to an attachment surface of the body, the method comprising:

selecting one of a plurality of possible orientations for the holder on an attachment surface of the body and attaching the holder at the base surface in the selected orientation to the attachment surface of the body, wherein the base surface has within an area over the attachment surface a shape which is profiled so that, for the selected orientation, a region defined between the base surface and the attachment surface is smaller than a region that would be defined if the base surface would have a flat shape.

The invention will be more fully understood from the following description of specific embodiments of the invention. The description is provided with reference to the accompanying drawings.

DETAILED DESCRIPTION OF SPECIFIC EMBODIMENTS

Figure 1:
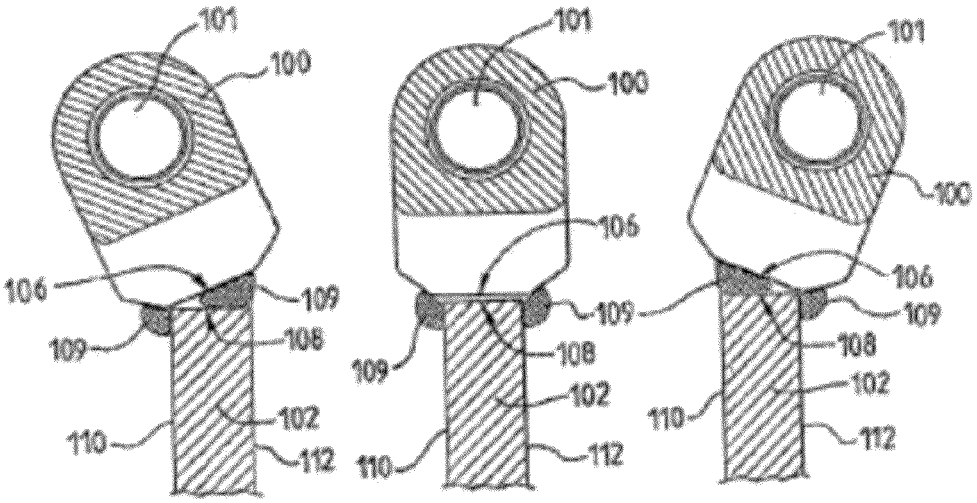
Fig. 1 (a) Fig. 1 (b) Fig. 1 (c) (Prior Art)
FIGS. 1 (*a*), (*b*) and (*c*) show cross-sectional representations of a prior art holders for holding a tooth on a body of a cutting blade, FIGS. 2 (*a*), (*b*) and (*c*) show cross-sectional representations of a holder for holding a tooth on a cutting blade according to an embodiment of the present invention.

Referring initially to FIGS. 1 (*a*) to (*c*), a prior art holder 100 for holding a tooth on a cutting blade is now described.

The prior art holder 100 is secured on a body 102 of a cutting blade by welding. The holder 100 comprises a portion 101 for receiving a tooth. The holder 100 has a flat base surface 106 and the body 102 has an attachment surface 108. Welding material 109 is formed at the base surface 106 and at the attachment surface 108 to attach the holder 100 to the body 102.

FIG. 1 (*a*) shows the holder 100 being positioned so that the holder 100 and a tooth that would be positioned in the holder 100 project more to the left side of the body 102. FIG. 1 (*b*) shows the holder 100 being positioned so that the holder 100 and a tooth that would be positioned in the holder 100 projects in a direction parallel to side portions 110 and 112 of the body 102. FIG. 1 (*c*) shows the holder 100 being positioned so that the holder 100 and a tooth that would be positioned in the holder 100 projects more to the right side of the body 102. Welding material 109 secures the holder 100 on the body 102.

Figure 2:
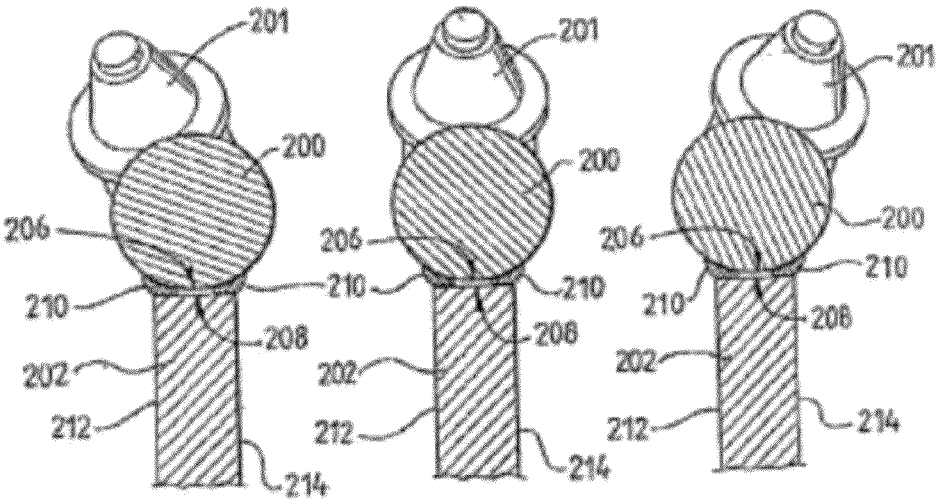

Referring now to FIGS. 2 (*a*) to (*c*), a holder 200 for holding a tooth on a body of a cutting blade or grinding drum according to an embodiment of the present invention is now described. The holder 200 holds a tooth 201 and is secured on a body 202 of a cutting blade by welding. It is to be appreciated that in an alternative embodiment the body may also be a body of a grinding drum.

In the embodiment illustrated in FIG. 2, the holder 200 has a curved base surface 206 and a circular cross-sectional shape. It is to be appreciated, however, that the holder 200 may alternatively have any other suitable cross-sectional shape and the base surface 206 may have any other suitable non-flat shape. The body 202 has an attachment surface 208. Welding material 210 is formed at the base surface 206 and at the attachment surface 208 attaching the holder 200 to the body 202.

FIG. 2 (*a*) shows the holder 200 being positioned so that the holder 200 and the tooth 201 project more to the left side of the body 202. FIG. 2 (*b*) shows the holder 200 being positioned so that the holder 200 and the tooth 201 project in a direction parallel to side portions 212 and 214 of the body 202. FIG. 2 (*c*) shows the holder 200 being positioned so that the holder 200 and the tooth 201 project more to the right side of the body 202.

Because the base surface 206 is curved, a gap formed between the base surface 206 and the attachment surface 208 is smaller for the tilted orientations shown in FIGS. 2 (*a*) and 2 (*c*) compared with a gap formed using the prior art holder 100 in corresponding orientations (see FIGS. 1 (*a*) and 1 (*c*)). Less welding material is required to secure the holder 200 in these orientations than to secure a prior art holder in corresponding orientations. Consequently it is possible to attach the holder 200 in a manner that results in superior mechanical strength compared to attachments possible with the prior art holders in corresponding orientations.

Figure 3:
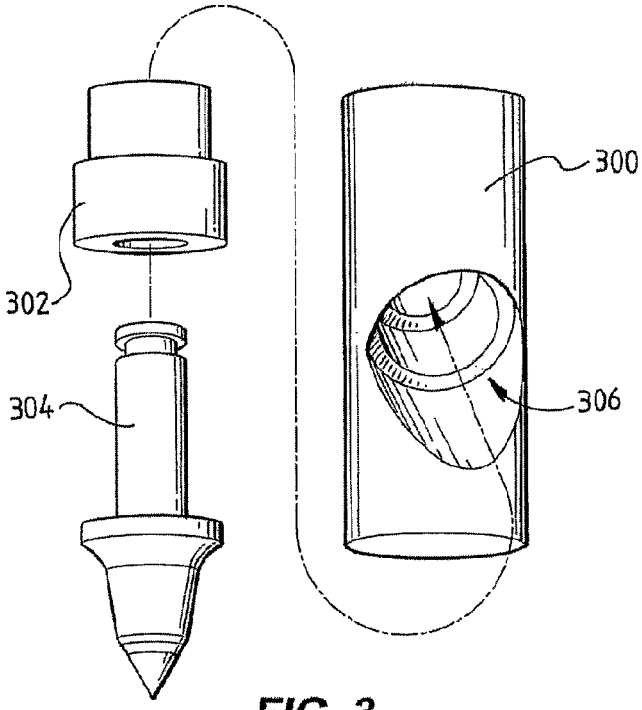
FIG. 3 shows components of a cutting blade according to a specific embodiment of the present invention.
Figure 4:
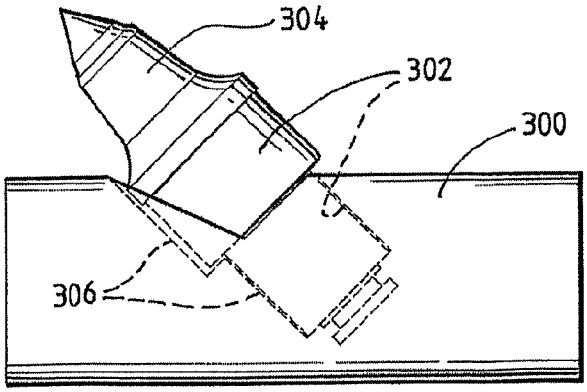
FIG. 4 shows assembled components of a cutting blade according to the specific embodiment of the present invention.

FIGS. 3 and 4 show a holder 300, a sleeve 302 and a cutting tooth 304 according to a specific embodiment of the present invention. FIG. 3 shows these components dissembled and FIG. 4 shows these components assembled. The holder 300 has a recess 306 for receiving the sleeve 302. The cutting tooth 304 is secured in the holder 300 via the sleeve 302 and the sleeve 302 is held in position by welding. In a variation of this embodiment the sleeve 302 is held in position by press-fitting or by soldering such as silver soldering. The holder 300 has an attachment surface (not shown) which is located opposite the recess 306.

In this embodiment the tooth 304 comprises a conical tip that is composed of tungsten and has a steel socket. The sleeve and the holders are composed steel.

Figure 5:
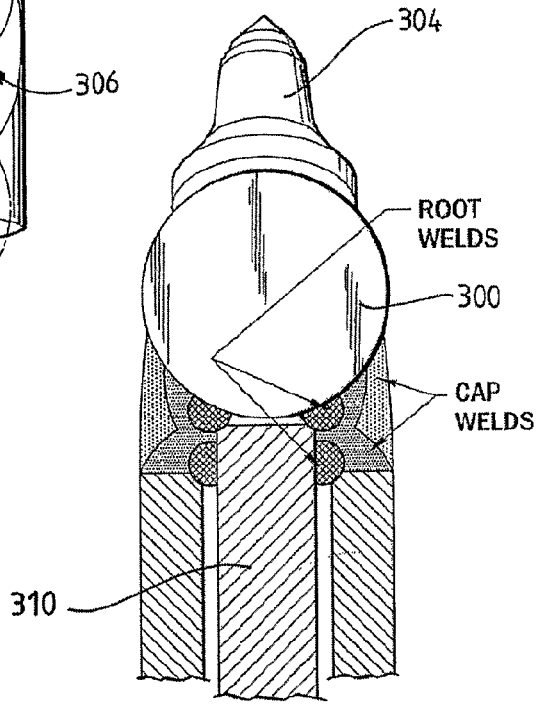
FIG. 5 shows a cross-sectional representation of components of a cutting blade according to the specific embodiment of the present invention.

FIG. 5 shows a cross-sectional representation of the holder 300 and the tooth 304 positioned in the holder 300 via sleeve 302 (not shown). Body 310 is schematically indicated and typically is a circular disc having a diameter of 1 to 5 meters. The holder 300 is in this embodiment secured on the body 310 by root-welds which are overlayed by cap-welds.

Figure 6:
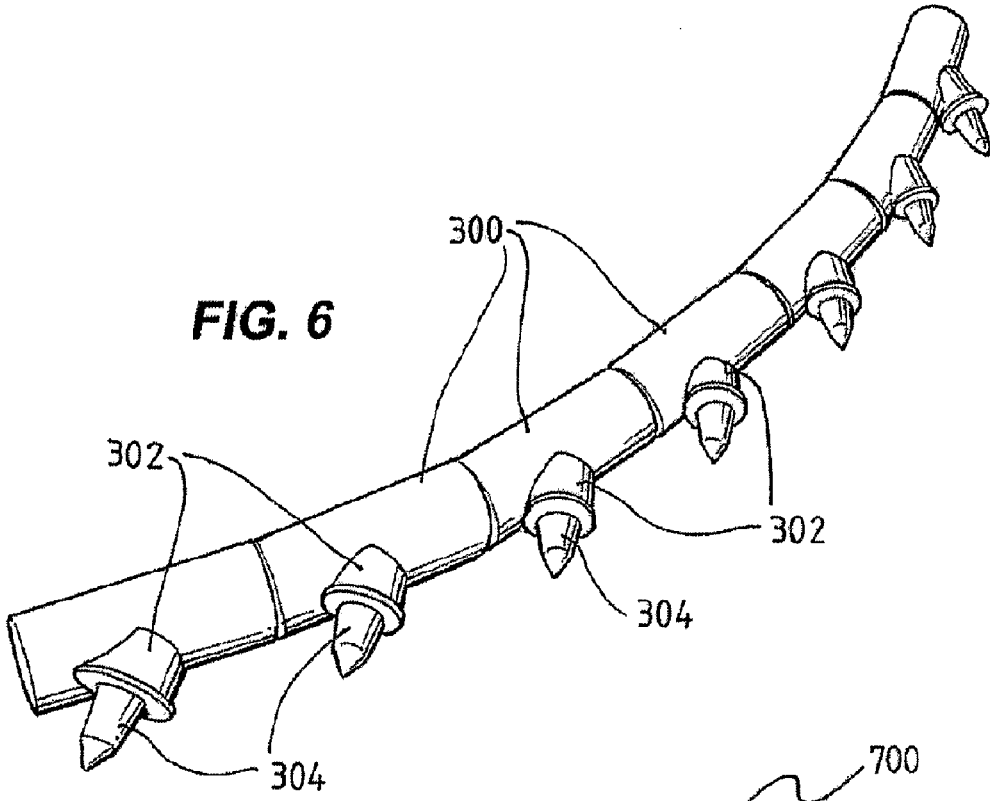
FIG. 6 shows a series of components of a cutting blade according to the specific embodiment of the present invention.

FIG. 6 shows a series of the holders 300 with sleeves 302 and teeth 304. For fabrication of a cutting blade initially a series of holders 300, which may comprise 50 or more holders, is positioned in an edge surface of the body 310. The holders are rotated on the body to their desired angular position and welded to the body as described above and illustrated in FIG. 5. The sleeves 302 are then inserted into the holders 300 and secured for example by welding. Adjacent holders 300 are then welded to one another at end-faces. The teeth 304 are inserted and secured in the holders 300 via the sleeves 302.

Figure 7:
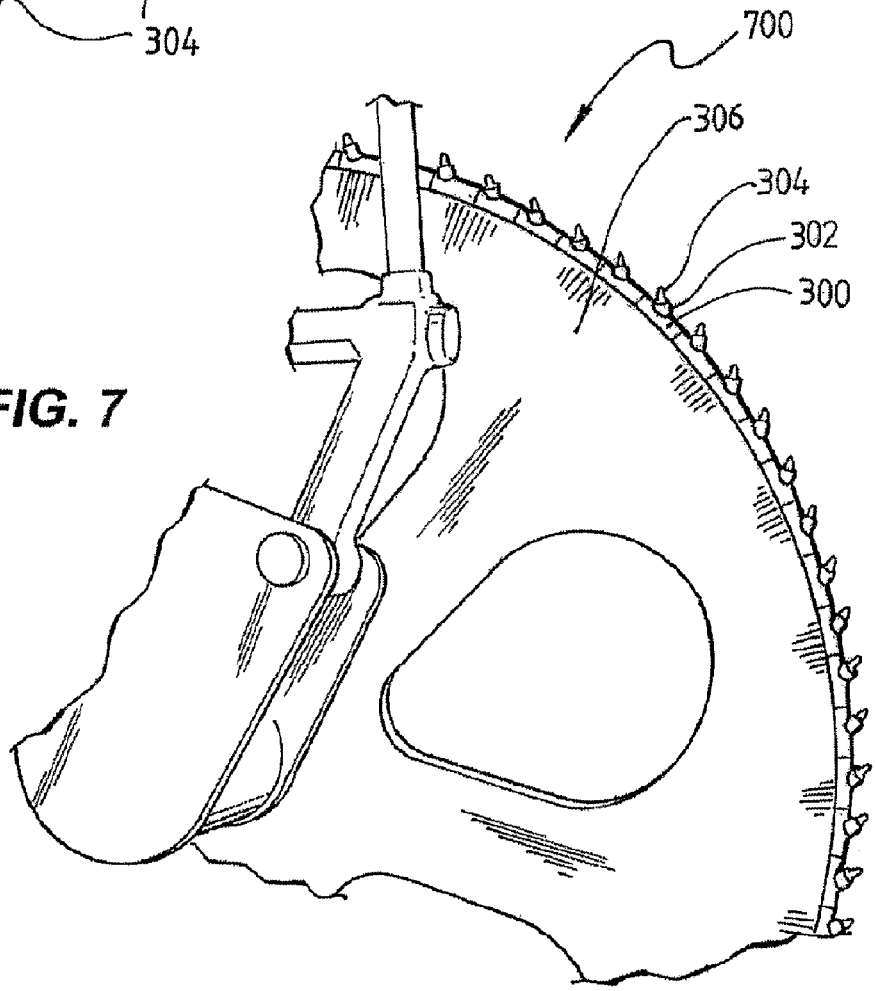
FIG. 7 shows a cutting blade according to a specific embodiment of the present invention and FIGS. 8 (*a*) and (*b*) show cross-sectional representations of assembled components of cutting blades according to other specific embodiments of the present invention

FIG. 7 shows a cutting blade according to a specific embodiment of the present invention. The cutting blade 700 comprises a series of the holders 300, sleeves 302 and teeth 304 which are secured on body 306 in the above-described manner.

It is to be appreciated that in variations of the described embodiments the holder may not comprise a separate sleeve but may be formed in one piece, for example by casting, and may include a portion for directly receiving a socket portion of a cutting tooth and which holds the cutting tooth in position.

Although the invention has been described with reference to particular examples, it will be appreciated by those skilled in the art that the invention may be embodied in many other forms. For example, the cutting teeth may not necessarily be attached to the holders by welding, but may alternative be held in position by pins or any other suitable means. FIGS. 8 (*a*) and (*b*) illustrate such other variations. FIG. 8 (*a*) shows a holder 800, a sleeve 802 and a cutting tooth 804 according to another specific embodiment of the present invention. The cutting tooth 804 is received by the sleeve 802, which comprises an internal annular recess 805 and the cutting tooth comprises an external annular recess 806. In this embodiment, the cutting tooth 804 is held in the sleeve 802 by spring clip 808, that is positioned in the recesses 804 and 806. The sleeve 802 also comprises an external annular recess 810 and is secured in the holder 800 by a pin 812 positioned in a bore of the holder 800 and penetrating through a portion of the recess 810. FIG. 8 (*b*) shows a related variation in which sleeve cutting tooth 811 comprises annular recess 812 and is held in the sleeve 803 by a friction clip 813.

Further, it is to be appreciated that in variations of the described embodiments the base surfaces of the holders 300 may not be curved, but may comprise a number, such as 4, 6, 8, 10 or more flat surface portions. Adjacent surface portions may define angles and the surfaces portions may be arranged so that all surface portions together approximate a curved shape. In addition, the base surface may not necessarily have a convexly curved shaped but may have a concave shape.

In addition, as indicated above, the body may not necessarily be a disc but may alternatively have a cylindrical shape and may be the body of a grinding drum. A person skilled in the art will appreciate that the described holder for holding a tooth, either directly or via the sleeve, may also be used for a grinding drum and manufacturing and repair steps are analogous to those described above in the context of cutting blades.

Additionally or alternatively the attachment surface of the body may have a not-flat shape which has, within the width of the attachment surface, a shape that is profiled so that a region defined between the base surface and the attachment surface is smaller than a region that would be defined if the attachment surface would have a flat shape. Further, the attachment surface may include side-portions of the body of the cutting blade or grinding drum and a holder attached to a side portions typically projects in a direction away from the side portion which gives that cutting blade of grinding drum added width.

The invention has been described in the context of cutting blades or grinding drums for cutting or grinding rock or hard earth formations. However, a person skilled in the art will appreciate that the defined cutting blades and grinding drums are suitable for cutting or grinding rock or hard earth formations, but are not limited to these applications. For example, the defined cutting blades and grinding drums may also be used for cutting concrete, bitumen on roads or even wood.

The invention claimed is:

1. A cutting blade for cutting rock or hard earth formations, the cutting blade comprising:

a body having an attachment surface at an outer peripheral surface portion of the body, and a plurality of tooth holders for holding teeth in a plurality of directions, each tooth holder holding one tooth and the plurality of tooth holders being oriented and attached on the body of a cutting blade within a common plane, each holder comprising:

a portion for holding the tooth in a manner such that a portion of the tooth projects from the holder, and a base surface at which the holder is welded to the attachment surface of the body, the base surface being located opposite the portion for holding the tooth and the holder being attachable by welding in a plurality of different orientations in which the tooth projects from the body in a predetermined direction, wherein the base surface has within an area over the attachment surface of the body of the cutting blade a rounded convex shape whereby a region defined between the base surface and the attachment surface is, for at least one of the plurality of different orientations, smaller than a region that would be defined if the base surface would have a flat shape.

2. The cutting blade of claim 1 wherein the entire base surface of each holder is curved.

3. The cutting blade of claim 1 wherein each holder has a circular cross-sectional shape.

4. The cutting blade of claim 1 wherein the portion for holding the tooth of each holder is arranged for holding the tooth via a sleeve.

5. The cutting blade of claim 4 wherein each holder comprises the sleeve.

6. The cutting blade of claim 1 wherein the plurality of tooth holders forms a series of tooth holders and each tooth holder abuts two adjacent tooth holders.

7. A method of attaching a plurality of tooth holders on a body of a cutting blade for cutting rock or hard earth formations, each tooth holder having a portion for holding one tooth in a manner such that a portion of the tooth projects from the holder and at least one of a rounded, convexly curved base surface that forms a convex shape for attaching the holder to an attachment surface at an outer peripheral surface of the body of the cutting blade, the base surface being located opposite the portion for holding the tooth, the method comprising:

selecting one of a plurality of possible teeth orientations for each holder on an attachment surface of the body and welding each holder at its base surface in the selected orientation to the attachment surface of the body at a location within a common plane, wherein the base surface has within an area over the attachment surface a shape which is profiled so that, for the selected orientation, a region defined between the base surface and the attachment surface is smaller than a region that would be defined if the base surface would have a flat shape.

* * * * *